United States Patent [19]

Brighton et al.

[11] Patent Number: 4,955,157

[45] Date of Patent: Sep. 11, 1990

[54] SMALL CALIBER AMMO CONVERSION KIT

[76] Inventors: Rich W. Brighton, 5015 S. Barton Pl., Seattle, Wash. 98118; Paul Safr, 1657 Dale St., London, Ontario, Canada, N5V 1Y3

[21] Appl. No.: 370,027

[22] Filed: Jun. 22, 1989

[51] Int. Cl.[5] ..... F41C 27/00

[52] U.S. Cl. ..... 42/77; 89/29; 102/446

[58] Field of Search ..... 42/77; 89/29, 128; 102/446

[56] References Cited

U.S. PATENT DOCUMENTS

| | | |
|---|---|---|
| 732,540 | 6/1903 | Garrison . |
| 976,459 | 11/1910 | Hartmann . |
| 1,179,021 | 4/1916 | Mayer . |
| 1,517,702 | 12/1924 | Brubaker . |
| 4,253,377 | 3/1981 | Arnett . |

FOREIGN PATENT DOCUMENTS

| | | | |
|---|---|---|---|
| 1042267 | 11/1978 | Canada | 102/446 |

*Primary Examiner*—Charles T. Jordan
*Assistant Examiner*—Richard W. Wendtland
*Attorney, Agent, or Firm*—Charles E. Brown; Charles A. Brown

[57] ABSTRACT

This relates to an inexpensive conversion kit for handguns wherein inexpensive small caliber shells may be fired from a large caliber handgun. The kit includes a special adapter shell which is formed of two separable housing members into which there is inserted a small caliber shell, for example a .22 caliber shell. This shell will generally be of the rim firing type, whereas the larger caliber shell of the handgun is normally of the center firing type. Accordingly, the adapter shell will also include a special rim firing, firing pin which will be activated by the conventional firing pin of the handgun. The kit further includes a special barrel which is readily mounted in the handgun as a replacement barrel and which has a breech for receiving only the adapter shell. The converted handgun will operate in the normal manner.

20 Claims, 3 Drawing Sheets

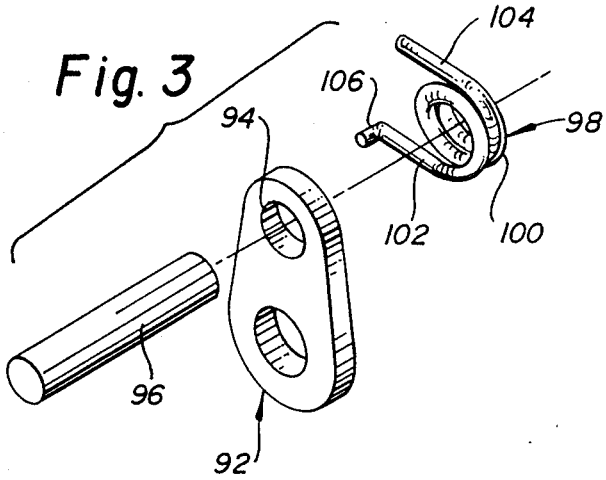
Fig. 3
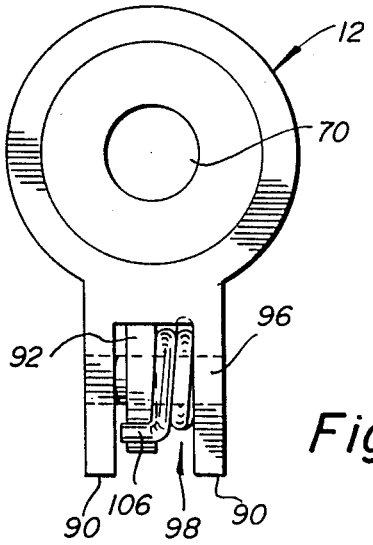
Fig. 4
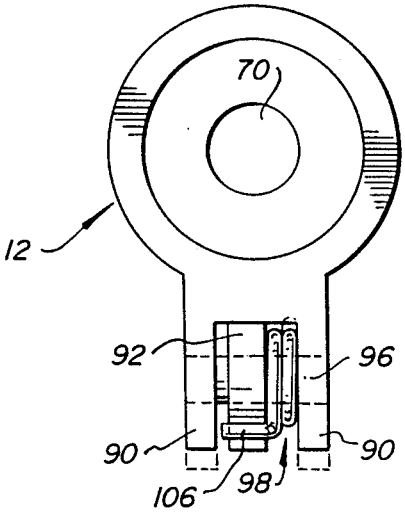
Fig. 5
Fig. 7
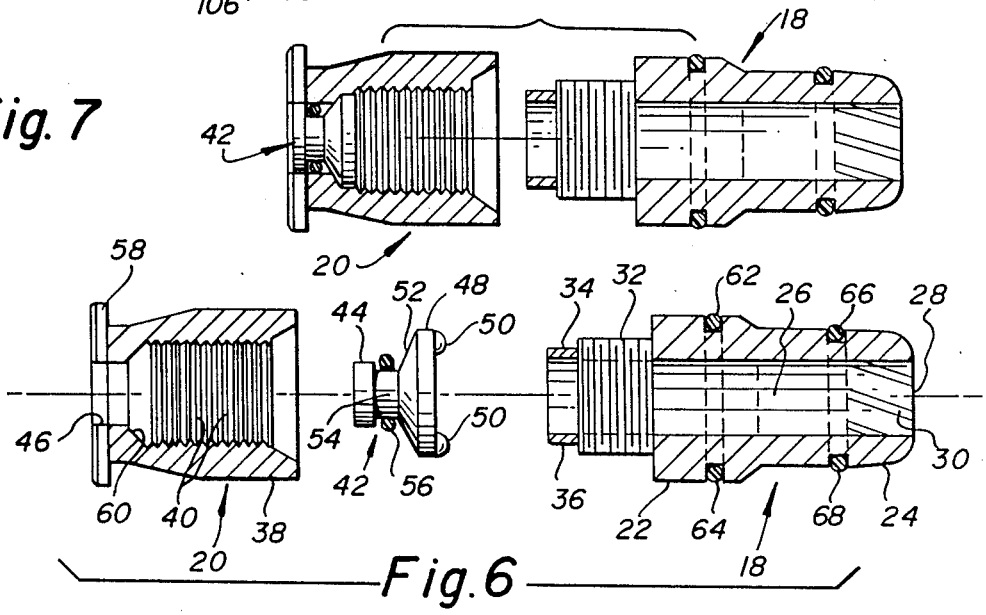
Fig. 6

SMALL CALIBER AMMO CONVERSION KIT

This invention relates in general to new and useful improvements in handguns and more specifically to a conversion kit for converting a large caliber gun to fire small caliber ammo.

Ammunition for large caliber guns is relatively expensive. On the other hand, .22 caliber rim fire ammo is very inexpensive. This invention relates to a conversion kit permitting one to use the cheap .22 caliber rim fire ammo in a larger caliber handgun.

The conversion kit includes a shell adapter for using small caliber ammo and an adapter barrel for receiving the shell adapter with the adapter barrel having a small caliber bore.

Further, the shell adapter is provided with its own firing pin so as to permit the use of rim fire ammo in a center fire handgun.

Except for the barrel adapter, only minor changes are required in the handgun to utilize the shell adapters. The adapter barrel is provided with a customary lock link which is provided with spring means for holding the barrel down when the conventional slide is retracted. The lock link cooperates with the recoil spring in the normal manner, although because of the lesser blowback from the small caliber ammo, the recoil spring may be modified by shortening the length thereof, or a special recoil spring may be provided.

The adapter barrel is constructed so that it will not receive the conventional ammo for which the handgun is intended.

A further feature of the invention is that the shell adapter, although it has its own firing pin, is so constructed that the firing pin will not be actuated should the shell adapter with a small caliber ammo load therein be dropped.

With the above and other objects in view that will hereinafter appear, the nature of the invention will be more clearly understood by reference to the following detailed description, the appended claims, and the several views illustrated in the accompanying drawings.

FIG. 3 is an exploded perspective view of the lock release link and the associated spring.

FIG. 4 is an end elevational view of the adapter barrel with the loaded release link and associated spring in position.

FIG. 5 is an end elevational view similar to FIG. 4 but wherein a standard link may be utilized and mounting arms of the adapter barrel modified as opposed to a modification of the load release link as required in FIG. 4.

FIG. 6 is an exploded sectional view with parts in elevational of a shell adapter in accordance with this invention.

FIG. 7 is a fragmentary sectional view showing the rim firing pin of the shell adapter in position within a respective housing member of the shell adapter.

Figure 1:
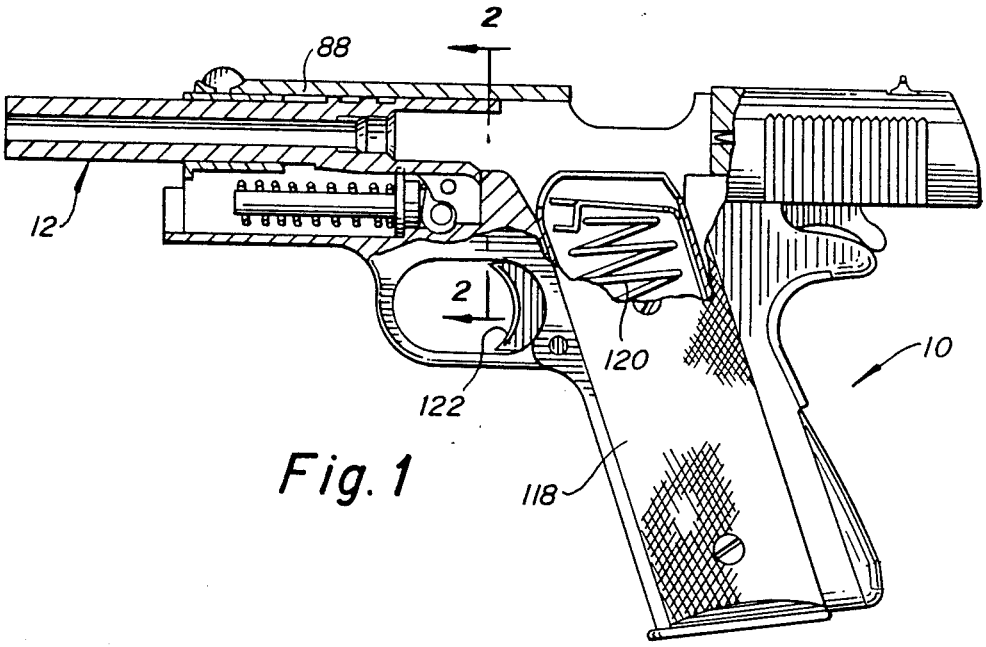
FIG. 1 is a side elevational view with parts broken away in section of a conventional handgun with the replacement or adapter barrel therein.

Referring now to the drawings in detail, reference is made first to FIG. 1 wherein there is illustrated a conventional handgun of the .45 caliber/9 mm caliber type equipped with a replacement barrel in accordance with this invention. The handgun per se is generally identified by the numeral 10 and the replacement barrel by the numeral 12.

The replacement barrel 12, in accordance with this invention, is especially configurated to fire small caliber ammo, such as .22 caliber rim fire shells as will be described hereinafter. The adapter barrel is particularly adapted to receive therein shell adapters, generally identified by the numeral 14 which carry .22 caliber shells generally identified by the numeral 16.

In view of the fact the shell adapter 14 is a principal feature of this invention, it will be described first.

With reference to FIGS. 6 and 7, it will be seen that the shell adapter 14 includes a first housing member, generally identified by the numeral 18, and a second housing member, generally identified by the numeral 20, the housing members 18, 20 being cooperable to receive therein a small caliber shell, such as the .22 caliber shell 16.

The first housing member 18 is of a stepped configuration including a large diameter rear portion 22 and a smaller diameter front portion 24 which provide an outline somewhat similar to the outline of the large caliber ammo for which the handgun is intended. The first housing member 18 is provided with a bore 26 throughout the length thereof for receiving a small caliber shell, such as the shell 16. The bore 26 is of a length greater than the length of the intended shell 16 and has a forward part 28 which is provided with rifling 30 so as to impart spinning to the slug of the small caliber ammo 16.

The first housing member 18 is provided with an externally threaded rear part 32 of a reduced diameter. The rear part terminates in an unthreaded reduced diameter part 34 of which a limited circumferential portion is of a reduced wall thickness as at 36 so that one may be able to engage the rim of the small caliber shell 16 with one's fingernail to extract the brass of the spent shell from the first housing member 18.

The rear housing member 20 is provided with a forward exterior portion 38 of a diameter matching the diameter of the portion 22 of the first housing member 18 so as to form a continuation thereof. The rear housing member 20 is further provided with an internally threaded forward bore 40 to threadedly receive the threaded rear part 32 of the front housing member 18.

The rear housing member 20 is of a length to have received therein a special firing pin, generally identified by the numeral 42. The firing pin 42 includes a rear cylindrical part 44 of a size to be slidably seated in a rear bore 46 of the second housing member 20. The firing pin 42 also includes an enlarged front portion 48 which carries a pair of rim firing, firing pin elements 50. The back of the front portion 48 is tapered as at 52 and terminates in an annular groove 54 which is positioned in advance of a cylindrical rear part 44. The groove 54 carries an O-ring 56 which forms a seal with the front part of the rear bore 46.

The second housing member 20 is provided at its rear end with a rim 58 which will cooperate with the standard ejector of the handgun 10. It is to be understood that the rim 58 is oversized which makes ejection possible with a non-locking barrel, the barrel being described in detail hereinafter.

As is best shown in FIG. 7, when the firing pin 42 is properly seated in the second housing member 20, the O-ring 56 will engage against an inner portion of the bore 46 with tapered portion 52 seated against a tapered surface 60 which forms a front enlargement of the bore 46 and which prevents the undue rearward projection of the firing pin 42 out of the bore 46 so that accidental firing of the shell 16 will not occur should the shell adapter with a loaded shell therein be dropped.

A further feature of the shell adapter 14 is that the first housing member 18 has an annular groove 62 formed in the part 22 and an O-ring 64 is seated therein. In a like manner, the part 24 is provided with an annular groove 66 in which a sealing O-ring 68 is seated.

Figure 2:
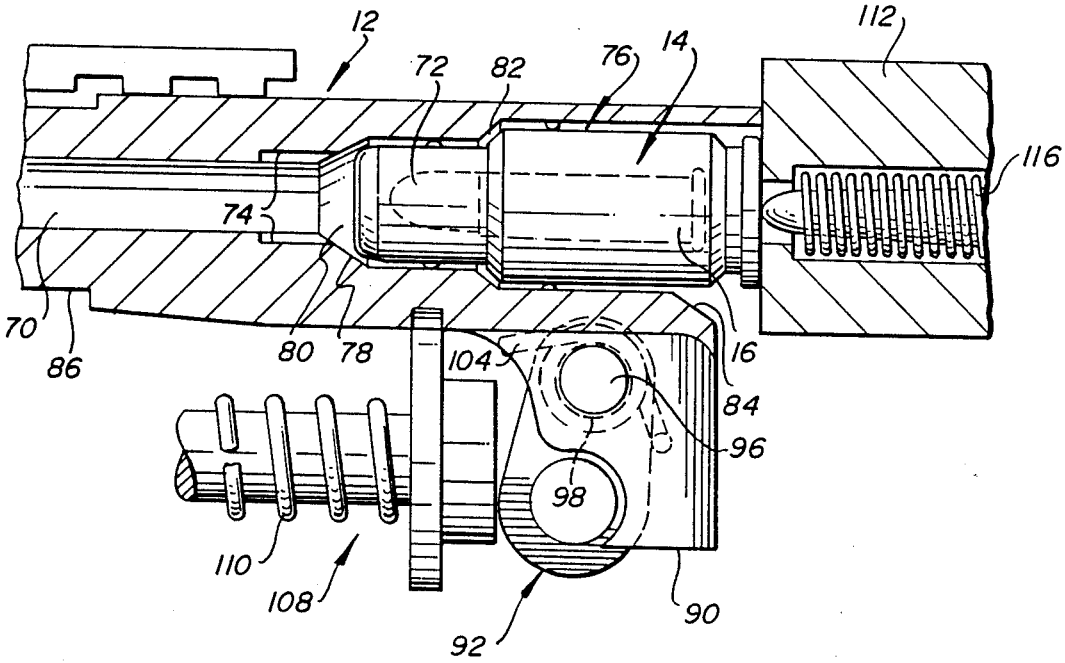
FIG. 2 is an enlarged fragmentary longitudinal sectional view with parts in elevation showing the adapter barrel having therein a shell adapter and with the adapter barrel being associated with the conventional handgun slide and firing pin as well as the recoil structure.

Reference is now made to FIGS. 1 and 2 wherein the details of the adapter barrel 12 are illustrated. First of all, the adapter barrel 12 has a bore 70 of a size for receiving in the usual guided relation a slug 72 of the small caliber shell 16. At the rear of the bore 70 there are longitudinally extending grooves 74 which function to eliminate lead fouling. Rearwardly of the grooves 74, the bore 70 opens into a stepped breech 76 which is configurated to receive the adapter shell 14. The breech 76, at the forward end thereof, is configurated to provide a special chambering system 78 which will not allow the insertion of the large caliber ammunition for which the handgun 10 is intended. Further, the forward portion of the breech 76 is tapered at 80 to provide for throated chambering to guide the small caliber slug 72.

The barrel 12 is provided with a tapered area 82 in the stepped breech 76 to provide for a blowback enhancement gas retention system.

The barrel 12 is provided at the open rear of the breech 76 in the lower part thereof with a custom feed ramp 84 to feed the adapter shell into the breech 76.

The forward part of the exterior of the barrel 12 is provided with an elongated barrel bushing relief system as at 86 for receiving a bushing 88 (FIG. 1).

At this time it is to be understood that the barrel 12 is a non-locking barrel. On the other hand, at the lower rear part of the barrel 12, there is provided a pair of integral depending, transversely spaced arms 90. The arms 90 carry a spring driven positive lock release link 92 which is best shown in FIG. 3. The link 92 is of a conventional construction and is provided in an upper part thereof with a bore 94 in which a pin 96 may be fitted. The pin 96 will pass through the arms 90 as is best shown in FIGS. 2 and 4.

The pin 96 will carry a spring 98 which includes a center coil arrangement 100 and a pair of arms 102, 104. The arm 102 is provided with an offset end 106. As is shown in FIG. 4, the end 106 will bear against the link 92 while, as shown in FIG. 2, the arm 104 will bear against the barrel 12, thus urging the link 92 in a clockwise direction as viewed in FIG. 2.

The link 92 bears against a rear part of a recoil mechanism, generally identified by the numeral 108. The recoil mechanism 108 includes a recoil spring 110.

At this time it is pointed out that either the link 92 will be a standard link which is machined to accommodate the spring 98, as shown in FIG. 4, or the link 92 will be a standard link and the arms 90 will be specially machined as shown in FIG. 5 to receive the standard link.

Also, with respect to the recoil spring 110, the recoil spring may be optional although it may have a portion of the coils cut away or could be a special recoil spring.

The remainder of the handgun 10 is standard and therefore will not be described except for a description of the conventional slide 112 which carries the conventional firing pin 114 which is held in a retracted position by a spring 116. It is to be understood that the slide 112 will move to the right to permit the feeding of a shell adapter 14 into the breech 76 and the extraction and ejection of a spent shell adapter. This arrangement is shown in FIGS. 8 through 12 which will be described hereinafter.

At this time it is to be noted that the conventional firing pin 114 is for a center firing shell whereas the inexpensive small caliber shells 116 are of the rim firing type. When the shell 16 is loaded into the first housing member 18, the rim of the shell will bear against the rear edge of the rear part 34 with the rim of the shell 16 being positioned for engagement by the rim engaging firing pins 50.

Figure 8:
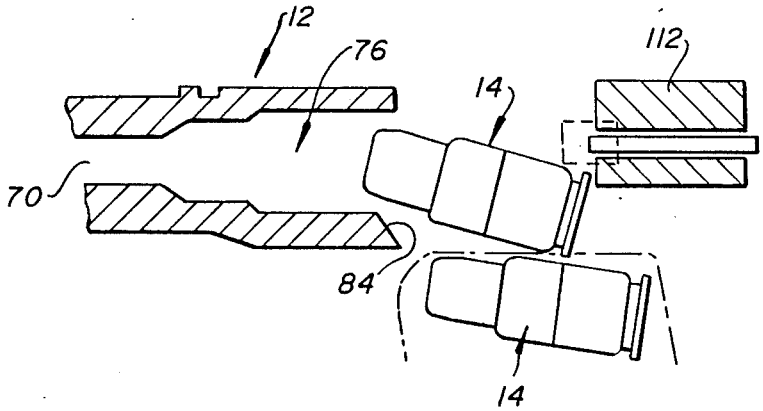
FIGS. 8, 9, 10, 11 and 12 are schematic sectional views showing in sequence the loading of a shell adapter into the adapter barrel, the firing of the shell loaded in the shell adapter and the ejection of the spent shell adapter.
Figure 9:
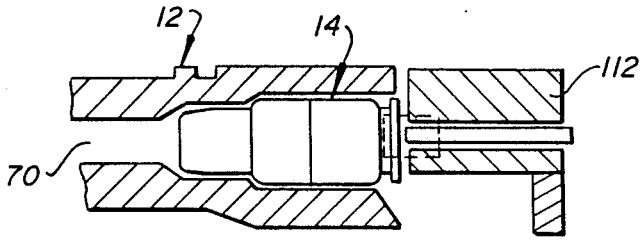
Figure 10:
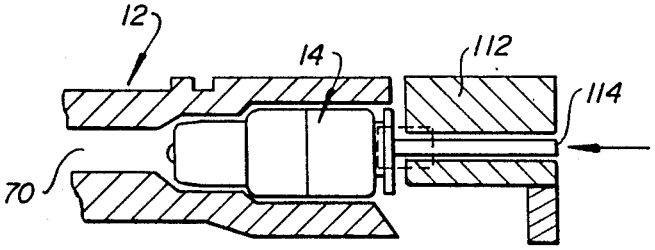
Figure 11:
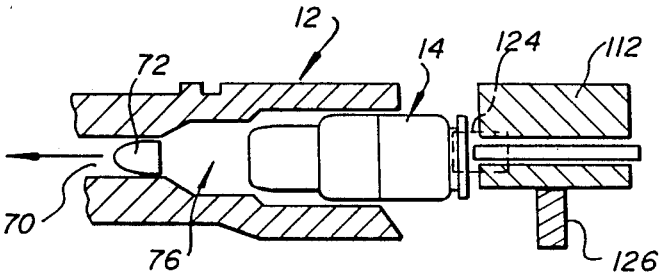
Figure 12:
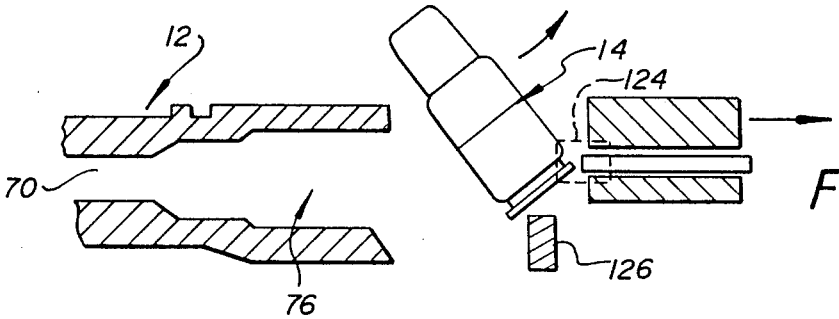

Referring specifically to FIG. 8, it will be seen that with the slide 112 retracted, a loaded shell adapter 116 may be automatically fed upwardly and into the breech 76 from the spring loaded magazine 118 by the spring 120 (FIG. 1). Once the adapter shell 14 is loaded in the breech, the slide 112 will move forward to the left in FIG. 1 to place the handgun 10 in condition for firing. When the trigger 122 of the handgun is pulled, it will cause the conventional firing pin 114 to move to the left to engage the firing pin 142 and cause the firing pin 142 to strike and fire the small caliber shell 16.

When the small caliber shell 16 is fired, and the slug 72 thereof passes out through the bore 90 of the barrel 12, the conventional blowback action will cause the adapter shell 14 to move rearwardly moving the slide 112 rearwardly in the conventional manner. As the slide 112 moves rearwardly, a conventional extracter 124 will draw the adapter shell 14 out of the breech 76 and thereafter be engaged by a conventional ejector 126 to discharge the adapter shell 14. With the ejector 126 moved to an out of the way position, the next following adapter shell 14 will be loaded into the breech 76 in the manner shown in FIG. 8. It is to be understood that with the small caliber shell having been spent, the discharged adapter shell 14 will be reclaimed. The two housing members of the adapter shell 14 will then be separated and the brass of the small caliber ammo 16 will be removed from the first housing part utilizing one's fingernail in the reduced wall thickness portion 36 of the rear part 34 to engage the rim of the brass. A new small caliber shell will then be placed in the front housing member 18 and the two housing members reassembled.

It is to be understood that the adapter shell 14 is particularly configurated and constructed for use with the adapter barrel 12 and that the two form a kit which will include a prescribed number of the adapter shells 14.

It is to be particularly noted that seals are formed between the adapter shell 14 and the breech 76 by the O-rings 62, 66 which engage the stepped inner surface of the breech 76 as is best shown in FIG. 2.

Although only a preferred embodiment of the inexpensive small caliber shell conversion kit has been specifically illustrated and described herein, it is to be understood that minor variations may be made in the kit construction and in the individual components thereof without departing from the spirit and scope of the invention as defined by the appended claims.

We claim:

1. A conversion kit for converting a large caliber gun to fire smaller caliber ammo, said kit comprising an adapter barrel for replacing an original barrel of the larger caliber gun and at least one separate small caliber shell adapter for carrying small caliber ammo, said barrel having a small caliber bore terminating in a rear breech for receiving the small caliber shell adapter carrying a small caliber ammo whereby the small caliber shell adapter is insertable and removable from said breech, and there being between said breech and said small caliber bore chambering for preventing chambering of originally intended large caliber ammo.

2. A conversion kit according to claim 1 wherein said small caliber shell adapter includes first and second housing members, said first housing member having a bore for receiving small caliber ammo of the type having a rim with such rim limiting entry of the rim into said first housing member, said second housing member having a bore of a size to receive the rim of the small caliber ammo rim, said first housing member having an end portion of a size to be received in said second housing member bore in telescoped relation, a firing pin seated in said second housing member bore for engaging small caliber ammo encased within said adapter to effect firing of such ammo, and sealing means carried by an exterior of said first housing member for forming a gas tight seal with said barrel bore.

3. An adapter barrel for using small caliber ammo in a larger caliber gun, said barrel having a small caliber bore terminating in a rear breech for receiving a small caliber shell adapter which carries small caliber ammo encased within the shell adapter, and there being between said breech and said small caliber bore chambering for preventing chambering of originally intended ammo.

4. An adapter barrel according to claim 3 wherein there is throated chambering for guiding small caliber ammo.

5. An adapter barrel according to claim 3 wherein said breech includes a special feed ramp for facilitating feeding of a small caliber shell adapter into said breech.

6. An adapter barrel according to claim 3 wherein said barrel is of the nonlocking locking type and carries a spring driven positive lock release link cooperable with a blowback unit including a recoil spring.

7. An adapter barrel according to claim 3 wherein said bore is provided adjacent to said breech with lead fouling eliminator grooves.

8. An adapter barrel according to claim 3 wherein said breech is of a stepped configuration and includes a blowback enhancement gas retention system.

9. An adapter barrel according to claim 6 wherein there is spring means cooperable with said barrel and said link for holding said barrel down when a cooperating gun slide is back.

10. A shell adapter for using small caliber ammo in a larger caliber gun, said shell adapter including first and second housing members, said first housing member having a bore for receiving small caliber ammo of the type having a rim with such rim limiting entry of the rim into said first housing member, said second housing member having a bore of a size to receive the rim of the small caliber ammo rim, said first housing member having an end portion of a size to be received in said second housing member bore in telescoped relation, a firing pin seated in said second housing member bore for engaging small caliber ammo encased within said shell adapter to effect firing of such ammo, and sealing means carried by an exterior of said first housing member for forming a gas tight seal with a barrel bore.

11. A shell adapter according to claim 10 wherein said second housing member bore is threaded and said first housing member end portion is of an external complimentary threading to releasably interlock said housing members whereby the small caliber ammo is encased within and removed from said shell adapter.

12. A shell adapter according to claim 10 wherein said second housing member bore is threaded and said first housing member end portion is of an external complimentary threading to releasably interlock said housing members, and said housing members having opposed abutting shoulders for limiting telescoping of said first housing member end portion into said second housing member bore.

13. A shell adapter according to claim 10 wherein said firing pin is of a type for converting the larger caliber gun from center fire to rim fire.

14. A shell adapter according to claim 10 wherein said firing pin is of a type for converting the larger caliber gun from center fire to rim fire, and includes a rear striker portion seated in a rear bore in said second housing member.

15. A shell adapter according to claim 14 wherein there is a gas seal between said firing pin and said second housing member in said rear bore.

16. A shell adapter according to claim 15 wherein said gas seal is formed by an O-ring carried by said firing pin.

17. A shell adapter according to claim 10 wherein said second housing member has a rear radially projecting rim for engagement of a shell ejector in a normal manner.

18. A shell adapter according to claim 14 wherein said rear striker portion is recessed within said rear bore to prevent accidental firing.

19. A shell adapter according to claim 10 wherein said sealing means is formed by at least one barrel engaging O-ring.

20. A shell adapter according to claim 10 wherein said first housing bore is of a length greater than the length of an intended small caliber shell and has a rifled front portion.

* * * * *